United States Patent [19]

Novotny

[11] 4,440,351

[45] Apr. 3, 1984

[54] APPARATUS FOR DELIVERING FLUID TO A ROTATING BODY

[75] Inventor: Carl F. Novotny, Greenfield, Wis.

[73] Assignee: Allis-Chalmers Corporation, Milwaukee, Wis.

[21] Appl. No.: 333,171

[22] Filed: Dec. 21, 1981

[51] Int. Cl.[3] ..... B02C 23/40

[52] U.S. Cl. ..... 241/41; 134/166 R; 241/171; 241/284; 366/154

[58] Field of Search ..... 241/38, 41, 54, 57, 241/170, 171, 176, 177, 178, 179, 284; 134/166 R, 167 R, 168 R, 171; 366/150, 154; 263/33 R

[56] References Cited

U.S. PATENT DOCUMENTS

| | | | |
|---|---|---|---|
| 1,216,667 | 2/1917 | Downs . | |
| 2,582,547 | 1/1952 | Kronstad | 241/54 |
| 2,805,827 | 9/1957 | Pierce | 241/171 |
| 3,202,364 | 8/1965 | Wieland | 241/30 |
| 3,661,370 | 5/1972 | Rossi | 263/33 R |

*Primary Examiner*—Howard N. Goldberg
*Assistant Examiner*—Timothy V. Eley
*Attorney, Agent, or Firm*—Timothy R. Conrad

[57] ABSTRACT

An apparatus is disclosed for feeding a fluid to a rotary body such as a cylindrical rotary mill. A rotary annular manifold is connected to the mill. A plurality of orifices in the face of the manifold, each with normally closed valves, allows the fluid to enter the manifold for subsequent distribution to the rotary mill. Fluid is transmitted to the rotary manifold from a stationary manifold. Fluid is transmitted to the stationary manifold from a fluid source. The stationary manifold has a cavity which is positioned against the rotary manifold and aligned over several of the orifices. As fluid, under pressure, enters the cavity in the stationary manifold, the fluid pressure opens the orifice valves and enters the rotary manifold. As the manifold rotates, orifices moving past the cavity close preventing the escape of fluid and subsequent orifices pass in front of the cavity allowing more fluid to enter the rotary manifold. The stationary manifold is held against the rotary manifold with a pressure at least equal to the parting force of the fluid in the cavity of the stationary manifold.

9 Claims, 7 Drawing Figures

APPARATUS FOR DELIVERING FLUID TO A ROTATING BODY

BACKGROUND OF THE INVENTION

1. Field of the Invention

This invention relates to an apparatus for delivering fluid to a rotating body. Particularly, this invention is directed toward an assembly for delivering a fluid from a stationary manifold to a rotary manifold mounted about and rotating with a rotary mill.

2. Description of the Prior Art

It is known to those familiar with the technology it would be desirable to introduce a fluid to a grinding mill during the grinding operation. The fluids are introduced for a variety of purposes including cooling and dust reduction. As indicated in U.S. Pat. No. 2,805,827 to S. C. Pierce dated Sept. 10, 1957, it is advantageous to introduce the fluid to the mill at predetermined points in the mill. The Pierce patent introduces the fluid to the mill through a cam/valve arrangement whereby scoops located on the mill shell collect fluid from a bath. When the scoops rotate with the mill to the top of the rotation, a cam opens a valve located within the scoop to permit the fluid to fall from the scoop into the interior of the mill.

U.S. Pat. No. 3,202,364 to W. Wieland dated Aug. 24, 1965, describes a grinding mill apparatus including a fluid supply which extends into the mill along the mill's axis of rotation. U.S. Pat. No. 2,582,547 to H. Kronstad dated Jan. 15, 1952, discloses an invention for the lateral injection of fluid to a mill. The Kronstad invention incorporates a wind box encircling the outside of a mill. The rotary motion of the mill forces air through the wind box and into the mill.

U.S. Pat. No. 1,216,667 to G. F. Downs dated Feb. 20, 1917, discloses an apparatus from delivering gases from a stationary source to a rotary kiln. The kiln is equipped with a rotary manifold mounted to the kiln shell. Conduits permit passage of the gas from the manifold to various locations along the kiln shell. A nonrotary annular plate is positioned against the manifold and secured gas-tight by springs forcing the plate against the rotating manifold. A wind box, connected to a stationary gas source, is mounting on the plate and permits passage of gas to the manifold for subsequent delivery to the kiln.

U.S. Pat. No. 3,661,370 to Rossi dated May 9, 1972, discloses a gas delivery manifold for use with a rotary kiln. In the Rossi patent, a gas manifold is positioned at one end of a rotary kiln. The manifold consists of two axially spaced rotary walls which rotate with the kiln. The walls are connected by a stationary sleeve which is connected by a conduit to a gas supply source. Connecting tubes mounted on the kiln extend to the rotary walls of the manifold. Gas is fed to various locations of the kiln by delivering the gas to the manifold through the stationary sleeve. The gas passes from the manifold through the connecting tubes and is delivered to the kiln.

SUMMARY OF THE INVENTION

It is an object of the present invention to provide a new and improved fluid delivery manifold assembly in which fluid from a stationary supply source is delivered to a tube mounted on the outer periphery of a mill whereby the tube rotates with the mill. The fluid is delivered to a stationary manifold having a cavity located adjacent to a rotary manifold mounted on the mill. The rotary manifold contains a plurality of orifices. Each orifice is equipped with a valve biased to close the orifice. As the mill rotates, the orifices move past the cavity in the stationary manifold. Pressurized fluid in the cavity opens the valve in the orifices and enters the rotary manifold for delivery to the mill through the delivery tube.

According to a preferred embodiment of the present invention, a rotary mill having a cylindrical shell is mounted for rotation about a generally horizontal axis. A fluid delivery tube is mounted on the mill shell and is connected to a port in the mill shell for delivery of fluid to the interior of the mill. The delivery tube extends axially away from the port to an annular rotary manifold connected to one end of the mill shell. The rotary manifold is mounted concentric to the mill shell and rotates with the shell. The rotary manifold has a feed face consisting of a plurality of circumferentially spaced orifices extending through the feed face into the rotary manifold. A valve is positioned within each orifice and each valve is biased to close the orifice.

A stationary manifold is positioned against a portion of the feed face. The stationary manifold has a cavity which is positioned over a minority of the orifices in the feed face of the rotary manifold. Fluid is supplied, under pressure, from a source to the cavity. As the rotary manifold rotates with the mill shell, the orifices pass the cavity in the stationary manifold and the pressurized fluid in the cavity opens the valves with the orifices and enters the rotary manifold. The fluid is delivered from the rotary manifold to the interior of the mill through the distribution tube. As the orifices move past the cavity, the valves close preventing escape of the fluid through the orifice. The stationary manifold is held in a mount consisting of a pressure wall, a top brace and bottom brace positioned so as to permit lateral movement of the stationary mount. A plurality of pistons are positioned in orifices within the pressure wall. Fluid under pressure is fed to the back of the pistons to urge the stationary manifold toward the rotary manifold. The total surface area of the piston face is at least equal to the surface area of the cavity within the stationary manifold so the force urging the stationary manifold toward the rotary manifold is at least equal to the parting force of the fluid within the cavity. Alternatively, a spring is positioned between the pressure wall and the stationary manifold with a spring force sufficient to provide a force greater than the parting force of the liquid in the cavity.

Other features and objects of the invention that have been attained will appear from the more detailed description to follow with reference to an embodiment of the present invention shown in the accompanying drawings.

DESCRIPTION OF THE PREFERRED EMBODIMENT

Figure 2:
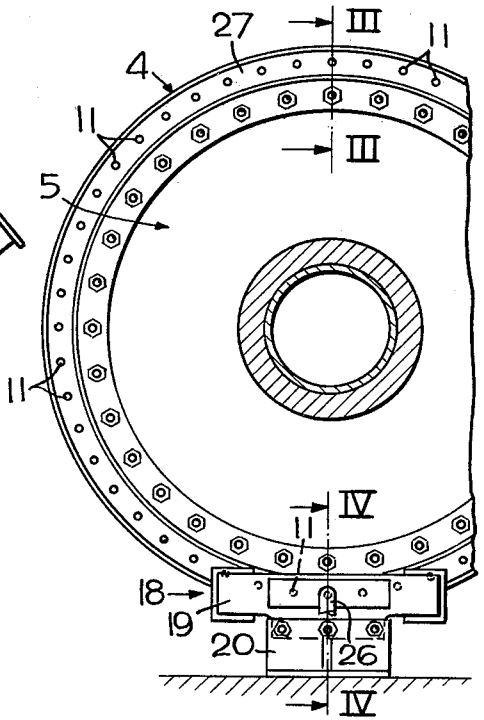
FIG. 2 is a front view of the mill taken along line II—II in FIG. 1.
Figure 1:
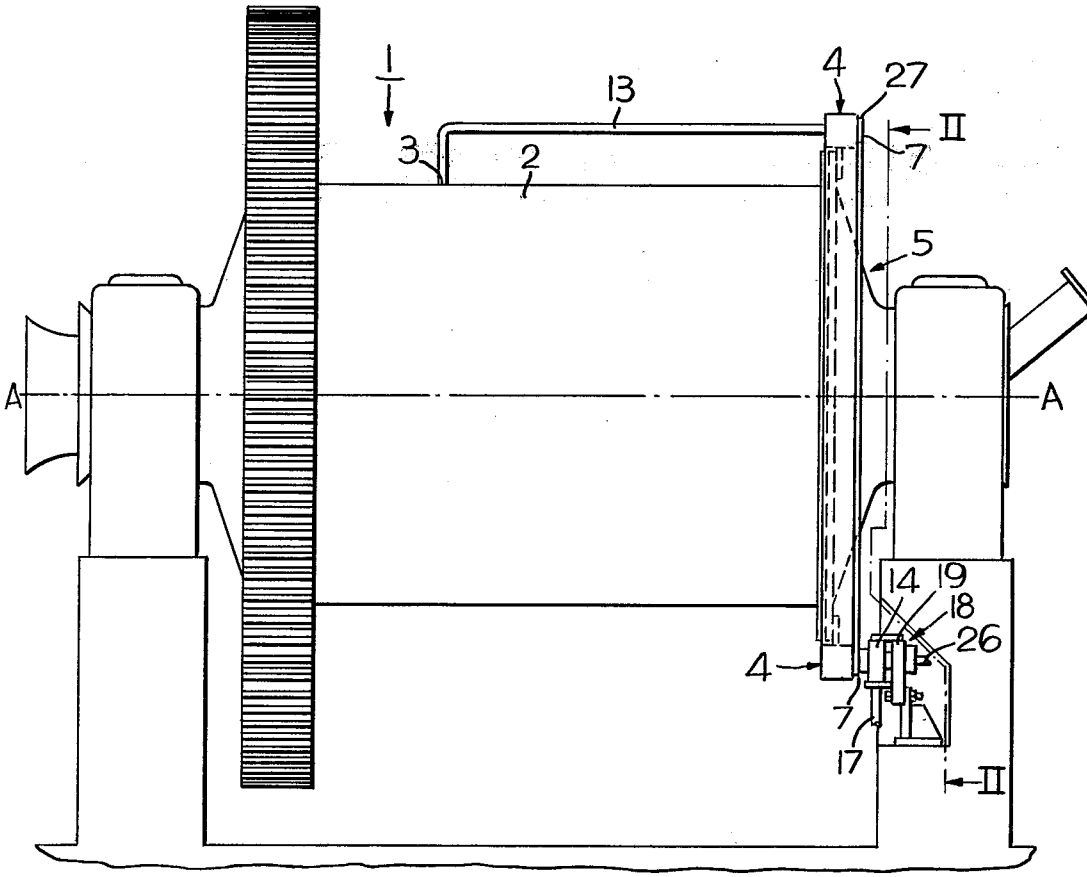
FIG. 1 of the accompanying drawings shows a side view of a rotary mill equipped with a rotary manifold and a stationary manifold for fluid supply.

Referring to FIGS. 1 and 2, a rotary mill 1 having a cylindrical shell 2 is supported in a conventional manner to rotate about a generally horizontal central axis A—A. Means for supporting and rotating a mill are well known in the art and form no part of this invention. The mill shell 2 is equipped with a fluid discharge port 3 projecting inwardly through the mill shell 2.

Figure 3:
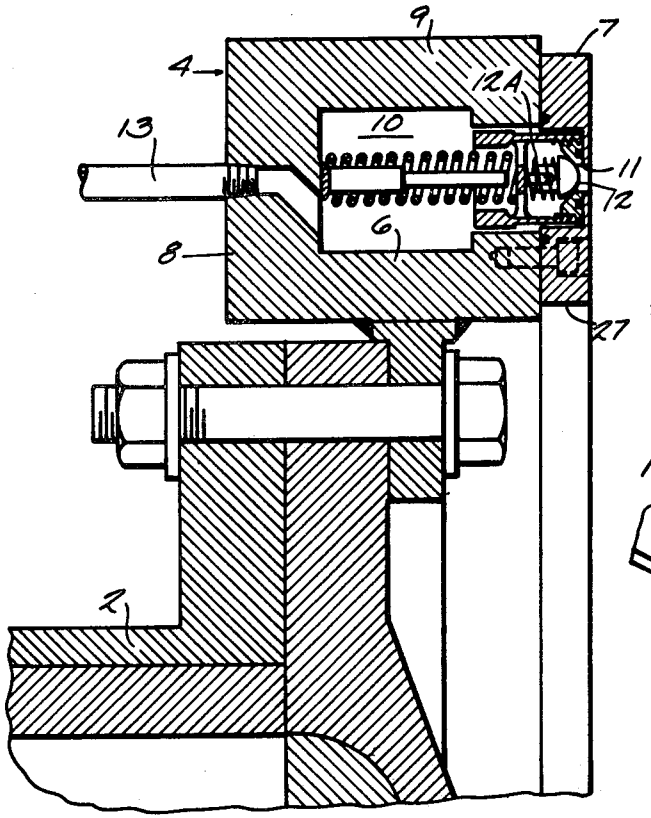
FIG. 3 is a view of the rotary manifold taken along line III—III of FIG. 2.
Figure 4:
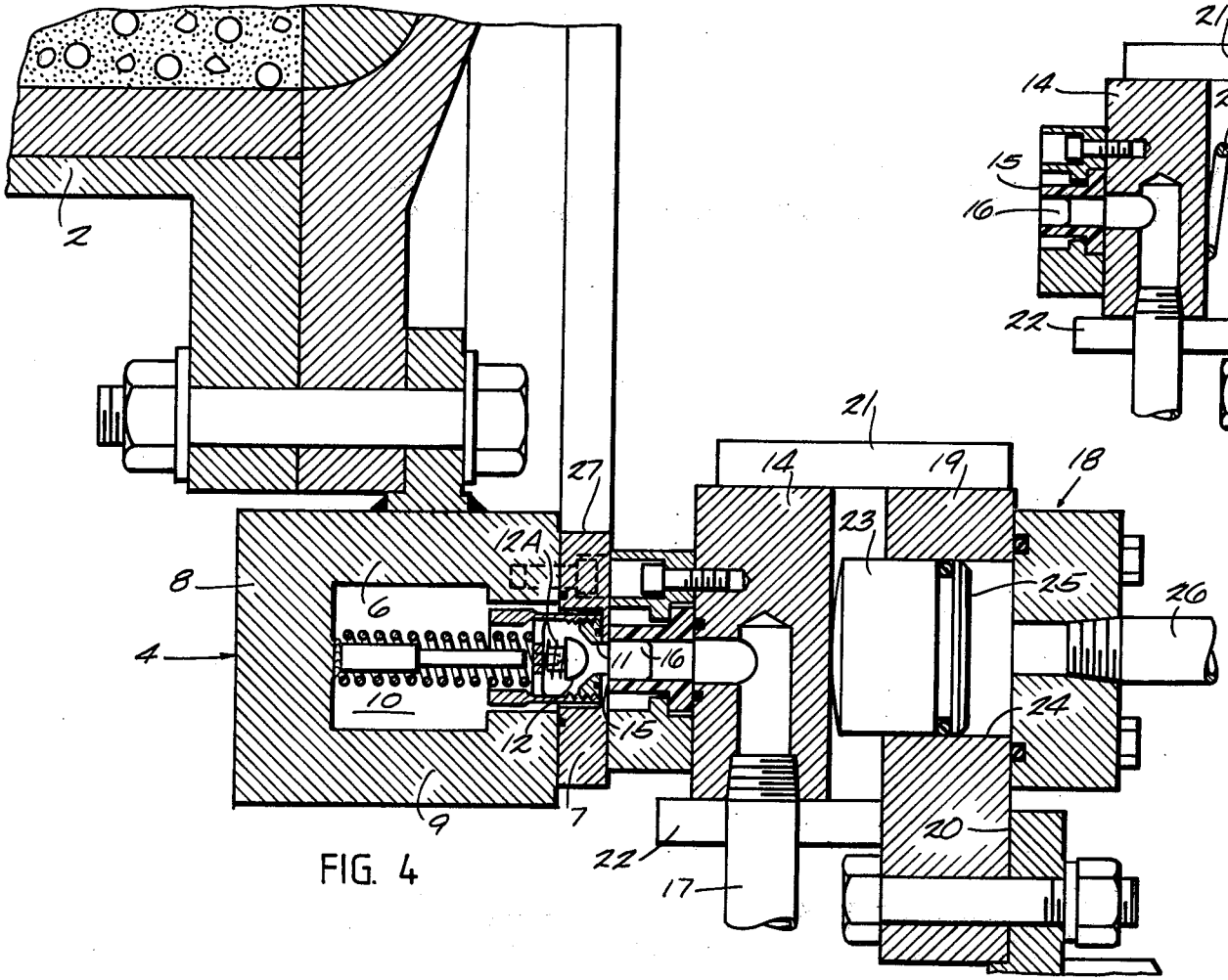
FIG. 4 is a view of the rotary manifold and the stationary manifold taken along line IV—IV in FIG. 2.

Referring to FIGS. 1, 2, 3, and 4, a rotary annular manifold box 4 is mounted concentrically about a fluid feed end 5 of the mill shell 2 and connected thereto by an annular collar 27 to rotate with the mill shell 2 about the central axis A—A. While the manifold box 4 is shown connected by annular collar 27 to the mill shell 2, it will be appreciated that an alternative method of affixing manifold box 4 to rotate about axis A—A is mounting manifold box to a drive shaft. The rotary manifold box 4 has a first portion which is an inner cylindrical wall 6 concentric to the central axis A—A of the mill shell 2; and a second portion which is an annular forward wall 7. The annular forward wall 7 is perpendicular to and affixed to the inner wall 6. The rotary manifold box has a third portion which is an annular rear wall 8 affixed to the inner wall 6 and parallel to the forward wall 7, and a forth portion which is an outer cylindrical wall 9 concentric to the central axis A—A of the mill shell 2 and affixed to the rear wall 8 and the forward wall 7. The inner wall 6, the outer wall 9, the rear wall 8 and the forward wall 7 define a cylindrical manifold cavity 10 within the rotary manifold box 4. Orifices 11 are positioned along the forward wall 7 of the manifold box 4 at equal distances from the central axis A—A of the mill shell 2. The orifices 11 are circumferentially spaced around the forward wall 7 and are equal distances apart as shown in FIG. 2. As shown in FIGS. 3 and 4, a plurality of valves 12 are provided within the manifold cavity 10 and are positioned over the orifices 11 and are biased to close the orifices 11. The design of the valves 12 forms no part of this invention and may be biased in any suitable manner, (e.g. as by springs 12*a* as shown in FIGS. 3 and 4). A fluid conduit tube 13 extends axially along the mill shell 2 connecting the discharge port 3 with the manifold cavity 10. While a singular fluid conduit tube 13 is shown, a plurality of such tubes may be provided for distributing fluid to a variety of ports distributed about the mill shell 2.

Referring to FIGS. 4, 5, 6 and 7, a stationary fluid supply manifold 14 is shown having a fluid feed face 15 positioned adjacent to and engaging a portion of the forward wall 7 of the rotary manifold box 4. The feed face 15 contains a cavity 16 which communicates with a portion of the forward wall 7 of the rotary manifold box 4 and which communicates with a selected number of the orifices 11 within the forward wall 7 (see FIG. 2) as said orifices 11 rotate past the stationary manifold 14. Conduit means 17 connects the cavity 16 to a stationary fluid source. Pressurized fluid from the fluid source enters the cavity 16 and applies a pressure against the bias of the valves 12 within the manifold cavity 10 opening said valve 12 and allowing fluid to pass from the stationary manifold 14 through the orifices 11 and into the rotary manifold 4. The pressurized fluid is transmitted from the rotary manifold 4 to the discharge port 3 through the fluid conduit tube 13 for discharge into the mill 1.

Figure 5:
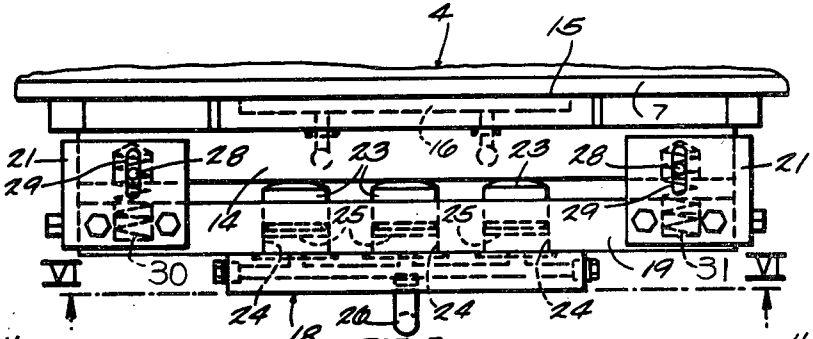
FIG. 5 is a top plan view of the stationary manifold.
Figure 6:
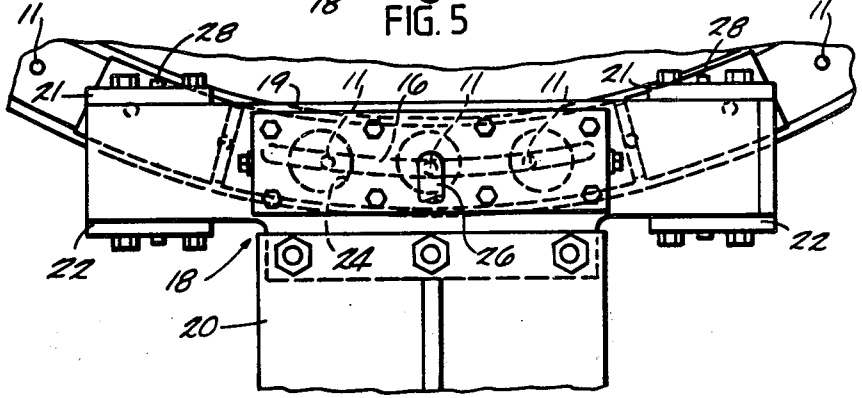
FIG. 6 is a view of the stationary manifold taken along line VI—VI in FIG. 5.

Referring to FIGS. 4, 5 and 6, a manifold mount 18 is shown for mounting the stationary manifold 14 against the forward wall 7 of the rotary manifold 4. The manifold mount 18 has a pressure wall 19 parallel to the feed end 5 of the mill shell 2. The pressure wall is affixed through any suitable means to a stationary surface 20. A pair of top braces 21 are affixed to the pressure wall 19 on the ends thereof and extend perpendicular toward the rotary manifold 4. A pair of bottom braces 22 are affixed to the pressure wall 19 on the ends thereof beneath the top braces 21 and extend perpendicular from the pressure wall 19 toward the rotary manifold 4. The top braces 21 and bottom braces 22 are positioned so as to hold the stationary manifold 14 with the cavity 16 over the selected number of orifices 11 as they rotate past the stationary manifold 14. The top braces 21 and bottom braces 22 are also positioned to allow lateral movement of the stationary manifold 14 within the manifold mount 18.

Guide rods 28 affixed to the stationary manifold 14 extend perpendicular therefrom through slots 29 centrally located in the top braces 21 (see FIG. 5).

Referring to FIGS. 4, 5 and 6, a plurality of pressure pistons 23 are shown with each comprising a cylindrical body within an orifice 24 within the pressure wall 19 of the manifold mount 18. The pistons 23 extend axially through the orifices 24 to bear upon the stationary manifold 14 and with each piston 23 having a pressure surface 25 remote from the stationary manifold 14. Conduit means 26 supplies pressurized fluid from the fluid source to the pressure surfaces 25 of the pressure pistons 23 thereby urging the stationary manifold 14 toward the forward wall 7 of the rotary manifold. Guide rods 28 within slots 29 ensure movement of the stationary manifold 14 in a direction perpendicular to the pressure wall 19. The pressure surfaces 25 have a total surface area at least equal to the surface area of the cavity 16 against the forward wall 7 of the rotary manifold 4 to exert sufficient pressure on the stationary manifold 14 against the forward wall 7 to prevent loss of fluid between the foward wall 7 of the rotary manifold 4 and the feed face 15 of the stationary manifold 14. Pressure wall 19 is provided with springs 30 and 31 extending therefrom and engaging the stationary manifold 14. The springs 30, 31 provide the initial force to maintain the feed face 15 abutting the forward wall 7 of the rotating manifold 9 when fluid is initially passed to the manifold 9. Springs 30, 31 further cooperate with the pistons 23 to ensure sufficient pressure on the stationary manifold 14 to prevent fluid loss.

Figure 7:
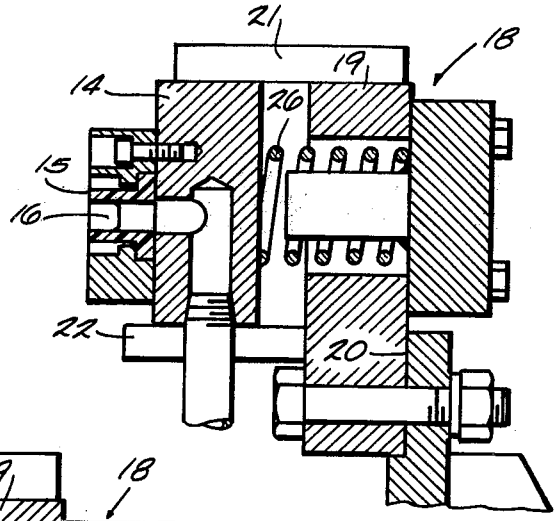
FIG. 7 shows a modification of the stationary manifold as shown in FIGS. 5 & 6.

FIG. 7 shows a variation of the embodiment as shown in FIGS. 4, 5 and 6. A spring 26 is positioned between the pressure wall 19 of the manifold mount 18 and the stationary manifold 14 urging the stationary manifold 14 toward the forward wall 7 of the rotary manifold 4.

The spring 26 is selected to exert a force at least equal to the parting force of the pressurized fluid within the cavity 16 against the forward wall 7 of the rotary manifold 4 to prevent the loss of fluid between the forward wall 7 of the rotary manifold 4 and the feed face 15 of the stationary manifold 14.

From the foregoing detailed description of the present invention it has been shown how the objects of the present invention have been attained in a preferred manner. However, modifications and equivalents of the disclosed concepts such as readily occur to those skilled in the art are intended to be included in the scope of this invention.

Thus, the scope of the invention is intended to be limited only by the scope of the claims such as are or may hereafter be, appended hereto.

The embodiments of the invention in which an exclusive property or privilege is claimed are defined as follows:

1. An apparatus for delivering fluid from a stationary source to a rotary body, such as a mill for treating particulate material with a fluid, said body having a generally horizontal axis of rotation and said body having support means and rotation means, improvement comprising:

a. a rotary annular manifold box concentric to said axis of rotation;

b. means for affixing said manifold box to said rotary body to rotate with said body;

c. a plurality of feed orifices in said rotary manifold box opening along an orifice axis parallel to said axis of rotation; each said orifice being a like distance from said axis of rotation;

d. valve means positioned within said rotary manifold box aligned with each of said feed orifices and biased to close said orifices;

e. conduit means for transmitting fluid from said manifold to said rotary body;

f. a stationary fluid supply manifold having a fluid feed face positioned adjacent to and engaging a portion of the rotary manifold through which a minority of the orifices open; said feed face containing a cavity communicating with the minority of feed orifices in the rotary manifold as said orifices rotate past the stationary manifold; and, g. conduit means for transporting pressurized fluid from a fluid source to said cavity within the stationary manifold whereby said fluid is transmitted from the cavity of said rotary manifold box to apply pressure against the bias of the valves aligned therewith thereby opening such valves and discharge fluid through said orifices to the conduit means for transmitting fluid to said rotary body.

2. An apparatus according to claim 1 wherein said rotary manifold box is connected to an annular collar mounted on said rotary body and affixed thereto; said collar extending radially outwardly from said rotary body.

3. An apparatus according to claim 2 wherein said rotary manifold box is comprised of an inner cylindrical wall concentric to said axis of rotation; an annular forward wall affixed thereto and perpendicular to said axis of rotation; an annular rear wall affixed to said inner wall and parallel to said forward wall, and an outer cylindrical wall concentric to said axis of rotation and affixed to said forward and rear walls; the walls of said manifold walls defining a manifold box; and said feed orifices being located in said forward wall.

4. An apparatus according to claim 3 wherein said feed orifices are of like distance from said axis of rotation and said orifice being circumferentially spaced apart equal distance.

5. An apparatus according to claim 4 comprising a mount for said stationary manifold comprising a pressure wall existing in a plane perpendicular to said axis of rotation, a pair of top braces affixed to and extending perpendicularly from a top of said pressure wall on ends thereof, a pair of bottom braces affixed to and extending perpendicularly from said pressure wall on ends thereof; said bottom brace positioned and aligned beneath said top braces to allow lateral movement of said stationary manifold between said top braces and bottom braces.

6. An apparatus according to claim 5 comprising spring means between said pressure wall of the manifold mount and said stationary manifold; said spring means urging said stationary manifold toward said rotary manifold.

7. An apparatus according to claim 5 wherein said top braces are provided with slots centrally located with said brace; said slots extending through said top braces and running perpendicularly to said pressure wall; guide rods affixed to said stationary manifold and positioned to extend therefrom through said slots; said guide rods cooperating with said slots to prevent movement of said stationary manifold parallel to said pressure wall of said manifold mount.

8. An apparatus according to claim 5 comprising a plurality of orifices in said pressure wall of said stationary manifold mount; said orifices extending through said pressure wall; piston means within each of said orifices; and piston means having a surface in communication with said stationary manifold and having a pressure surface remote from said stationary manifold; conduit means for supplying the fluid from a fluid source to said piston means at said pressure surface; said piston means urging said stationary manifold toward said rotary manifold.

9. An apparatus according to claim 8 comprising said piston having a total area of said pressure surface at least equal to the surface area of the cavity within said stationary manifold.

* * * * *

UNITED STATES PATENT OFFICE

CERTIFICATE OF CORRECTION

Patent No. 4,440,351 Dated April 3, 1984

Inventor(s) Carl F. Novotny

It is certified that error appears in the above-identified patent and that said Letters Patent are hereby corrected as shown below:

Column 6, line 41, "and" should read ---said---.

Signed and Sealed this

Twenty-fourth Day of July 1984

[SEAL]

Attest:

GERALD J. MOSSINGHOFF

Attesting Officer

Commissioner of Patents and Trademarks